United States Patent [19]

Delery

[11] Patent Number: 4,733,484

[45] Date of Patent: Mar. 29, 1988

[54] SKI BOOT

[75] Inventor: Marc Delery, Caluire, France

[73] Assignee: Compagnie Francaise d'Articles de Sport, DuPont, France

[21] Appl. No.: 910,671

[22] Filed: Sep. 23, 1986

[30] Foreign Application Priority Data

Oct. 9, 1985 [FR] France ..... 85 15157

[51] Int. Cl.[4] ..... A43B 5/04

[52] U.S. Cl. ..... 36/120; 36/54

[58] Field of Search ..... 36/117–121, 36/54

[56] References Cited

U.S. PATENT DOCUMENTS

| | | | |
|---|---|---|---|
| 4,085,528 | 4/1978 | Delery . | |
| 4,095,356 | 6/1978 | Robran et al. | 36/121 |
| 4,447,970 | 5/1984 | Delery | 36/121 |
| 4,461,103 | 7/1984 | Annovi | 36/121 |
| 4,470,206 | 9/1984 | Annovi | 36/121 |
| 4,565,017 | 1/1986 | Ottieri | 36/120 |
| 4,601,177 | 7/1986 | Leonardi | 36/120 |
| 4,622,765 | 11/1986 | Baratto et al. | 36/120 |
| 4,667,424 | 5/1987 | Sartor et al. | 36/120 |

FOREIGN PATENT DOCUMENTS

| | | | |
|---|---|---|---|
| 374094 | 3/1984 | Austria . | |
| 0166213 | 1/1986 | European Pat. Off. | 36/117 |
| 3247206 | 7/1983 | Fed. Rep. of Germany . | |
| 3529209 | 2/1986 | Fed. Rep. of Germany | 36/117 |
| 2495901 | 6/1982 | France . | |
| 2557776 | 7/1985 | France | 36/117 |

*Primary Examiner*—James Kee Chi

*Attorney, Agent, or Firm*—Parkhurst & Oliff

[57] ABSTRACT

A ski boot in plastic material includes a shell adapted to receive the foot, a front spoiler articulated on the shell for pivoting frontwards thereof and adapted to grip the bottom part of the leg, a buckle system for tightening the front spoiler on the bottom part of the leg, and a damper joined to the shell and to the front spoiler. A flexible arciform plate is further provided which adopts the general shape of the instep, an upper end of the plate being joined to the front spoiler, and a lower end of the plate being joined to the shell, the upper end of said arciform bending plate cooperating with a compressible elastic return element during leaning forward movements.

6 Claims, 4 Drawing Figures

SKI BOOT

BACKGROUND OF THE INVENTION

The present invention relates to a new improved ski boot, particularly of the rearward opening type.

It is conventionally known that a rearwardly opening ski boot essentially comprises:

on the one hand, a shell adapted to receive the foot;

on the other hand, a front spoiler, articulated on the shell;

and finally, means for closing and tightening the assembly on the leg.

In a ski boot, the "forward inclination", also called the "bending angle", designates the angle formed between the vertical plane and the rear part of the boot, namely the inclination of the skier with respect to the vertical. Many solutions have already been proposed for controlling that forward inclination, such as, for example, that described in applicant's U.S. Pat. No. 4,085,528. These solutions however, are not really adequate to satisfactorily dampen the spring movement of the front spoiler on the shell and to elastically return said spoiler during the leaning forward movement.

In his French Pat. No. 2,557,776, the applicant has described a rearwardly opening ski boot permitting the control of either the forward inclination, or the damping, but not both at the same time, using a damping compressible element which is joined to the shell and to the front spoiler. Although this solution has proved satisfactory at the technical level, it has regretfully been found to be rather complex at the mechanical level, hence expensive (U.S. Pat. No. 3,718,995 also refers).

SUMMARY OF THE INVENTION

It is the object of the present invention to overcome the aforesaid drawbacks by proposing a ski boot of the type indicated hereinabove, in which it is possible not only to control the forward inclination, but also to control simultaneously the elastic return of the front spoiler on the shell during leaning forward movements.

The ski boot according to the invention is of plastic material and of the type comprising:

a shell adapted to receive the foot, a front spoiler articulated on the shell for pivoting frontwards thereof and adapted to grip the bottom part of the leg, means for tightening the front spoiler on the bottom of the leg, damping means joined to the shell and to the front spoiler, characterized in that:

it comprises a flexible arciform bending plate which adopts the general shape of the instep and the two ends of which are respectively joined:

the upper end to the front spoiler, and the lower end to the shell, and in that the upper end of said arciform bending plate cooperates with a compressible elastic return element during leaning forward movements.

In other words, the rearwardly opening ski boot according to the invention is characterized in that the front spoiler and the shell are joined together via the arciform bending plate provided at the instep level, which plate cooperates with a compressible element so that the energy stored during the leaning forward movements is restored:

on the one hand, by deformation of said arciform plate, and on the other hand, by compressibility of the compressible element cooperating with said arciform plate.

Advantageously, in practice:

said arciform bending plate is in rigid plastic material;

each end of said bending plate is equipped with means for respectively controlling:

the forward inclination on the side of the junction with the shell, and the damping of the compressible element, on the side of the junction with the front spoiler;

the lower end of the arciform bending plate is provided with teeth situated on the top of the plate and adapted to cooperate with complementary teeth provided under a part which is slidable in a transverse direction in a housing provided in the shell, which housing is situated at the level of the tarsus and metatarsus, said slidable part being actuated by way of an external lever articulated on the end of the slidable part, this being made possible by a cam provided on the articulated end of the lever while resting on the shell;

the upper end of the arciform bending plate, which is secured to the front spoiler above the instep, cooperates with a multi-position control cam secured to the front spoiler, said cam resting on a means forming spring integral with the plate;

the control cam is composed of a maneuvering knob, placed on the front spoiler and fast with a driving axis of the cam proper which rests on the spring, the end of which driving axis is slidable in a slot provided at the upper end of the arciform plate;

the end of the cam driving axis sliding in said slot is engaged in a plate fixed on the front face of the front spoiler;

the means forming spring is constituted by an elastomeric block inserted in a housing provided in the plate beneath the slot in which slides the cam driving axis.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
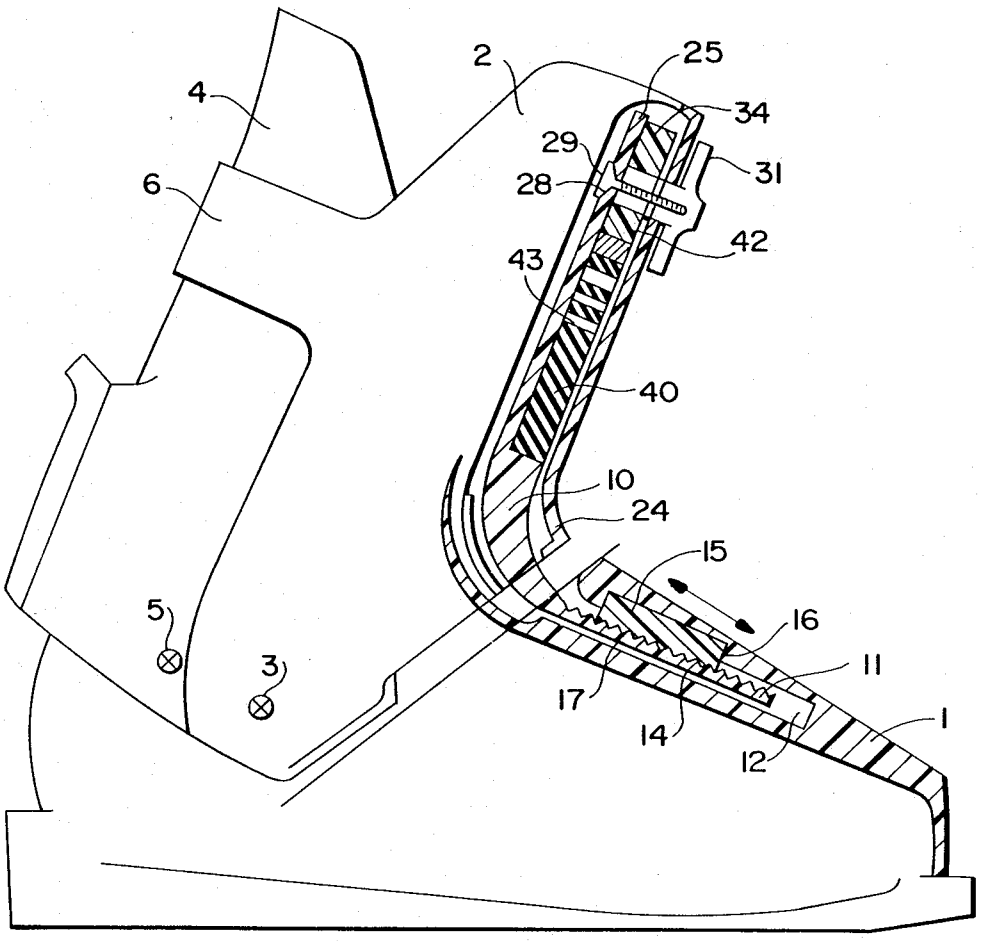
FIG. 1 is a cross-sectional view of a ski boot according to the invention.
Figure 2:
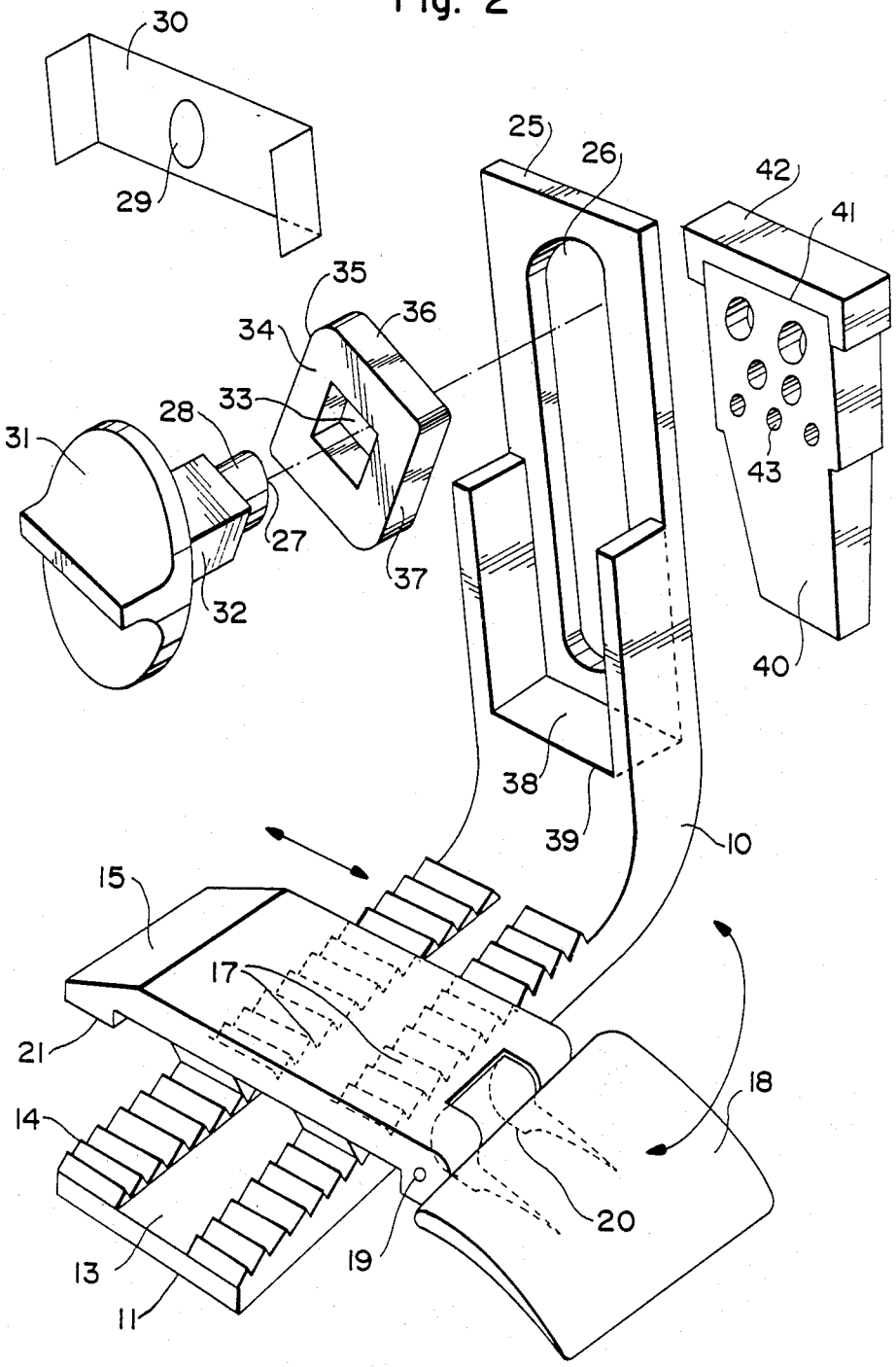
FIG. 2 is a simplified exploded perspective view of the characteristic device of the invention.

As illustrated in the figures, the ski boot according to the invention is composed of a shell (1) in injected plastics, and of a front spoiler (2) also in plastics, which spoiler is articulated forward at (3), a rear spoiler (4) being articulated rearward at (5) on the shell (1). A buckle system (6) is provided for tightening the front spoiler (2) and the rear spoiler (4) around the leg of the skier whose foot is inserted in the shell (1).

According to the characteristic of the invention, the ski boot comprises an arciform plate (10) situated in the plane of symmetry along the instep, said plate being made of injected plastics, such as polyamide reinforced with fiberglass.

The lower end (11) of the plate (10) is placed inside a housing (12) provided in the shell (1) at the level of the tarsus and metatarsus. The upper face (13) of the lower end (11) is provided on each side with two parallel sets of regular teeth (14) cut at 45°, each set forming a rack. Transversely and above said end (11) (FIGS. 3 and 4), a part (15) slides inside another housing (16) integral by molding and situated on top of the shell (1). The internal face of said slidable part (15), which is adapted to be brought in facing relationship to (13), is also provided with two parallel sets of teeth (17) which are complementary to teeth (14) and designed to engage therein. Said part (15) is equipped at one end with a lever (18) fixed on the outside on the top of shell (1), preferably on the outer side of the boot. Said lever (18) is pivotally mounted at (19) on the end of the part (15). The internal face of the end of the lever (18) is provided, at the level of the pivoting axis (19), with a cam (20) adapted to bear at (22) on the shell (1) (FIGS. 3 and 4) thus causing the part (15) to slide in transverse direction as indicated by arrow F. The other opposite end of part (15) comprises an element (21) for blocking such transverse horizontal sliding movement (F) in order to prevent the part (15) from coming out of the housing (16). The space between the two parallel sets of complementary teeth (14) and (17) could be at least equal to the width of said teeth so as to allow disengagement of the teeth (14,17) as illustrated in FIG. 4, and as designated by reference (L).

On the contrary, the upper end (25) of the arciform plate (10), which is designed to be joined to the shell (1), goes down to the level of the bottom of the leg, under the front part (40) of the front spoiler (2). Said end (25) is provided with a vertical oblong slot (26) the object of which is to allow the sliding of the plate (10) during leaning forward movements on the end (27) of an axis called driving pin (28) secured in (29) to a U-shaped plate (30), which plate thus forms a control point for blocking the rearward deflection of the boot. Thus, plate (10) is able to bend towards the front, hence to deform, whereas, on the contrary, it is blocked in position during rearward deflection by such control point on shell (1).

The driving pin (28) is integral with a maneuvering knob (31) situated on the front spoiler (2). Said pin (28) further comprises a square-shaped part (32), adapted to engage in a complementary square hole (33) provided in the position-adjusting cam (34). Said cam (34) thus presents three sides, a small side (35), a medium side (36) and a large side (37), respectively. Said cam (34) and more particularly its faces (35,36,37) cooperate with a block of elastomer (40) inserted inside a housing (38) closed by a flange (39) provided in the upper part (25) of plate (10), beneath the sliding slot (26).

Figure 3:
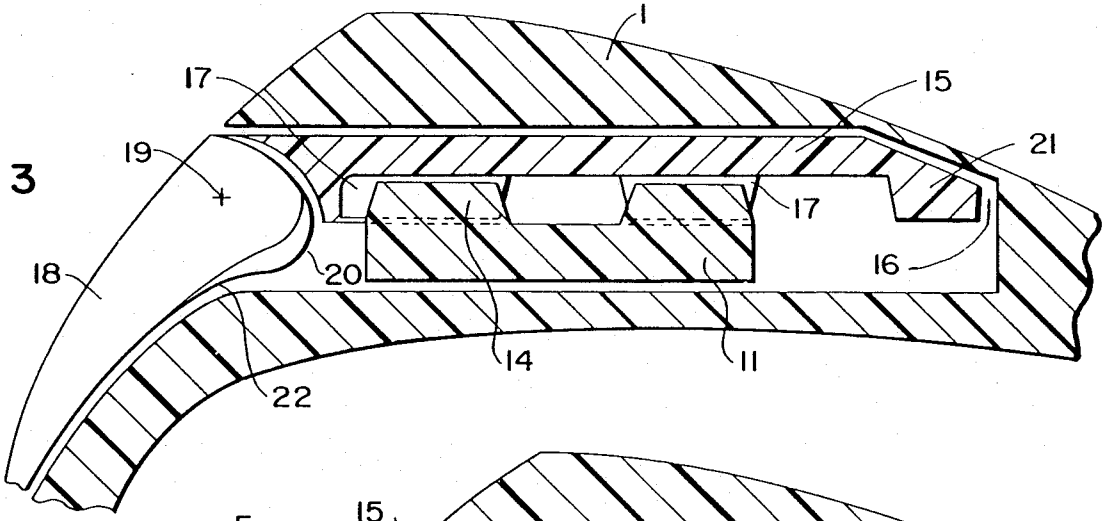
FIGS. 3 and 4 are cross-sectional views of the characteristic end of the arciform plate, and more specifically of the slidable part shown with disengaged teeth (FIG. 3), and with engaged teeth (FIG. 4).
Figure 4:
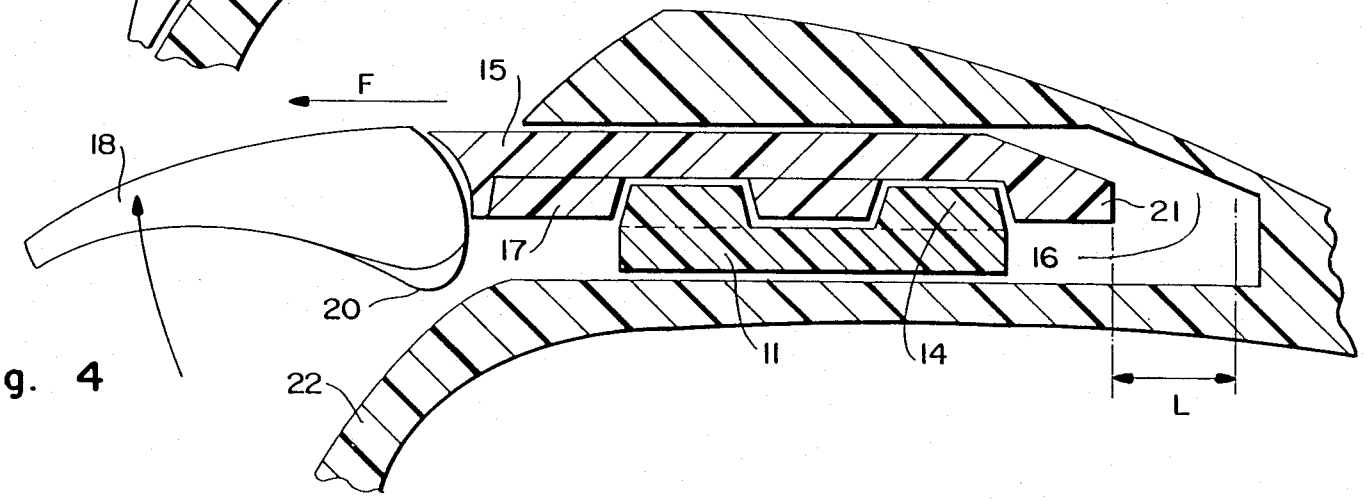

To control the forward inclination, the skier actuates the articulated lever (18) in order to release the sliding part (15) (FIG. 4). In this position, the teeth (14) and (17) are disengaged one from the other since the shift is in the direction L. The part (15) is then in disengaged position. With his leg, the skier causes the front spoiler (2) to pivot about pivot (3) on shell (1) until the desired position is reached. Then, lever (18) only needs to be lowered again, said lever, through the action of cam (20), locking the mobile part (16) by engaging its teeth (17) into the complementary teeth (14) positioned over upper face (13) of lower end (11) of the arciform bending plate (10). The forward inclination is thus adjusted and the position is locked (FIG. 3). This is therefore a simple device which virtually never wears out and which makes it possible to alter that adjustment at any desired time.

To adjust the damping of the leaning forward movements, the skier actuates the maneuvering knob (31) by pivoting it a quarter turn.

Advantageously, according to an improved embodiment, the upper end (41) of the block of elastomer (40) acting as damping means, receives a metallic part (42) which slides into slot (26) and also serves as a support for the faces (35,36,37) in question of the cam (34) in which are provided the through holes (43) permitting adjustment of the position. The comressible block (40) thus makes it possible to vary the length of the arch of arciform plate (10), hence the distance between the upper and lower bearing points.

Then, the more the skier brings his weight forward, the more he bends the characteristic arch of arciform plate (10) and the more he compresses the compressible block (40). There is therefore an interaction between the characteristic plate (10) and the compressible block (40), hence a combination of bending and compression.

It is thus possible, according to the invention, to achieve at the same time, simply and efficiently, the control of the forward inclination and simultaneously the elastic return of the front spoiler on the shell, which, heretofore, could not reliably be done at reasonable cost.

What is claimed is:

1. A ski boot in plastic material comprising:
a shell adpated to receive the foot;
a front spoiler articulated on the shell for pivoting frontwards thereof, and adapted to grip the bottom part of the leg;
means for tightening the front spoiler on the bottom part of the leg; and
damping means comprising a flexible bending arciform plate situated in the plane of symmetry and adopting the general shape of the instep, said arciform plate being joined by its lower end to the shell at the level of the tarsus and metatarsus, said lower end comprising means for adjusting the forward inclination, and said arciform plate being further movably secured by its upper end to the front spoiler above the instep, said upper end cooperating with a compressible elastic return element during leaning forward movements.

2. A ski boot according to claim 1, wherein the adjusting means of the lower end of said arciform bending plate includes teeth which are designed to cooperate by engagement with complementary teeth provided on the internal face of a sliding part which is slidable transversely inside a housing provided on the top of the shell at the level of the tarsus and metatarsus, said sliding part being awctuated by an external lever mounted for pivoting on the end of the sliding part via a cam provided on the pivoting end of the lever while resting on a point of the shell.

3. A ski boot according to claim 1, wherein the upper end of said arciform bending plate, which is secured to the front spoiler above the instep, cooperates with a multi-position control cam fixed on the front spoiler, said control cam resting on the compressible element which is integral with the arciform plate.

4. A ski boot according to claim 3, wherein said control cam is composed of a maneuvering knob which is placed on the front spoiler and which is fast with a pin for driving said cam, said cam driving pin resting on the compressible element and the end of said cam driving pin sliding in a slot provided at the upper end of the arciform plate, wherein the end of said cam driving pin which slides in said slot is engaged in a securing plate fixed on the front face of the front spoiler.

5. A ski boot according to claim 4, wherein said cam driving pin has a portion with a square cross-section, said cam driving pin portion cooperating with a complementary square hole cut into the control cam.

6. A ski boot according to claim 4, wherein the compressible element comprises a block of elastomer inserted in a housing provided in the arciform plate beneath the slot in which slides the end of the cam driving pin.

* * * * *